US005174565A

United States Patent [19]

Komori

[11] Patent Number: 5,174,565

[45] Date of Patent: Dec. 29, 1992

[54] BASEBALL PITCHING MACHINE

[75] Inventor: Yutaka Komori, Ayase, Japan

[73] Assignee: Taito Corporation, Tokyo, Japan

[21] Appl. No.: 777,612

[22] Filed: Oct. 16, 1991

[51] Int. Cl.[5] ..... A63B 69/40

[52] U.S. Cl. ..... 273/26 D; 273/29 A; 124/7

[58] Field of Search ..... 273/26 D, 29 A; 124/5, 124/6, 4, 34, 36, 78

[56] References Cited

U.S. PATENT DOCUMENTS

| | | | |
|---|---|---|---|
| 3,277,879 | 4/1964 | Sayette | 273/26 D |
| 3,659,576 | 5/1972 | Eade | 273/26 D |
| 3,724,437 | 4/1973 | Helstead | 273/26 D |
| 3,807,379 | 4/1974 | Vodinh | 273/26 D |
| 4,442,823 | 4/1984 | Floyd | 273/26 D |
| 4,712,534 | 12/1987 | Nozato | 273/26 D |
| 4,774,928 | 10/1988 | Kohlin | 273/26 D |
| 4,834,060 | 5/1989 | Greene | 273/26 D |

*Primary Examiner*—Theatrice Brown
*Attorney, Agent, or Firm*—Rogers & Killeen

[57] ABSTRACT

A baseball pitching machine includes a ball throwing assembly that is mounted on a platform that may be tilted to adjust the elevation of a baseball pitched by the machine. The device for controlling the tilt of the platform may include plural jack screws for stabilizing the platform between pitches. The angle of inclination of the platform recorded in the device for controlling the tilt of the platform may be corrected when the platform has a predetermined inclination to improve the accuracy of the pitched ball. The correction updates the recorded angle of inclination so that vibrations caused by the ball throwing assembly or malfunctions do not disrupt the operation of the machine to the point where the ball is pitched wildly. A photocoupler provides a corrective signal when the predetermined inclination is reached.

5 Claims, 3 Drawing Sheets

BASEBALL PITCHING MACHINE

BACKGROUND OF THE INVENTION

The present invention relates to pitching machines for providing baseball batting practice and more specifically to an improved pitching machine and method in which the elevation of a pitched ball is consistently accurate.

Coin operated pitching machines for providing baseball batting practice are widely used at playgrounds and batting centers. Some pitching machines have a ball throwing assembly with a catapult-like pitching arm that is propelled by means of energy stored in a spring. A baseball is supplied to the radially outward end of the pitching arm and, upon release of the spring, thrown toward a home plate where it may be addressed by a batter. Typically, the batter may select both the location and the speed of the pitched ball or may select a random distribution of locations and speed. In order for such machines to operate effectively, the pitched ball must cross the plate at the selected location and speed with reasonably consistent accuracy. Further, the machine should operate safely in that the ball should not be thrown wildly either at the batter or so that it may ricochet and hit the batter.

Heretofore, pitching machines have not been able to maintain the requisite accuracy over long periods of time. For example, the repeated release and arrest of the pitching arm may cause the machine to vibrate and displace the settings for the location of the pitched ball to the point where the ball is pitched wildly. The machine is thereafter ineffective until the settings are reestablished manually. See for example the pitching machines with catapult-like pitching arms in U.S. Pat. No. 3,659,576 to Eade, et al. and Japanese Patent Publication No. 58-8855.

It is desirable that the pitching machine include a mannequin or other human-like form so that the batter faces a more realistic looking pitcher. To this end, the ball throwing assembly may be hidden behind a mannequin and one of the mannequin's arms may be replaced with the pitching arm of the ball throwing assembly. Movement of the ball throwing assembly and the mannequin may be coordinated to effect a realistic pitching movement. For example, the head may nod, a leg may kick and the non-throwing arm may move.

The platform on which the mannequin and ball throwing assembly are mounted may be moved to adjust the location of the pitched ball. Typically, the platform is inclined to adjust the elevation of the pitched ball crossing home plate. However, when the mannequin and the ball throwing assembly are so mounted the accuracy of the pitched ball may degrade with time. Specifically, the controls for inclining the platform may become misaligned so that the elevation of the pitched ball is no longer consistently accurate. Further, the platform may continue to vibrate after a pitch is thrown so that the location of the next pitch is not accurate. See, for example, the pitching machines having a mannequin and ball throwing assembly mounted on a moveable platform in Japanese Design Application No. 61-129,615 and Japanese Utility Application Disclosure No. 63-38,560.

Accordingly, it is an object of the present invention to provide a novel pitching machine and method that obviates the problems of the prior art.

It is a further object to the present invention to provide a novel pitching machine and method in which the elevation of the ball pitched by the machine is consistently accurate.

It is yet a further object to the present invention to provide a novel pitching machine and method in which the means for inclining the platform on which the ball throwing assembly is mounted is updated when the platform has a predetermined inclination so that the elevation of a ball pitched by the machine may be consistently accurate.

It is still a further object to the present invention to provide a novel pitching machine and method in which the platform on which the machine is mounted is stabilized between pitches so that a ball may be pitched accurately.

These and many other objects and advantages will be readily apparent to one skilled in the art to which the invention pertains from a perusal of the claims, the appended drawings and the following detailed description of preferred embodiments.

DETAILED DESCRIPTION OF PREFERRED EMBODIMENTS

Figure 1:
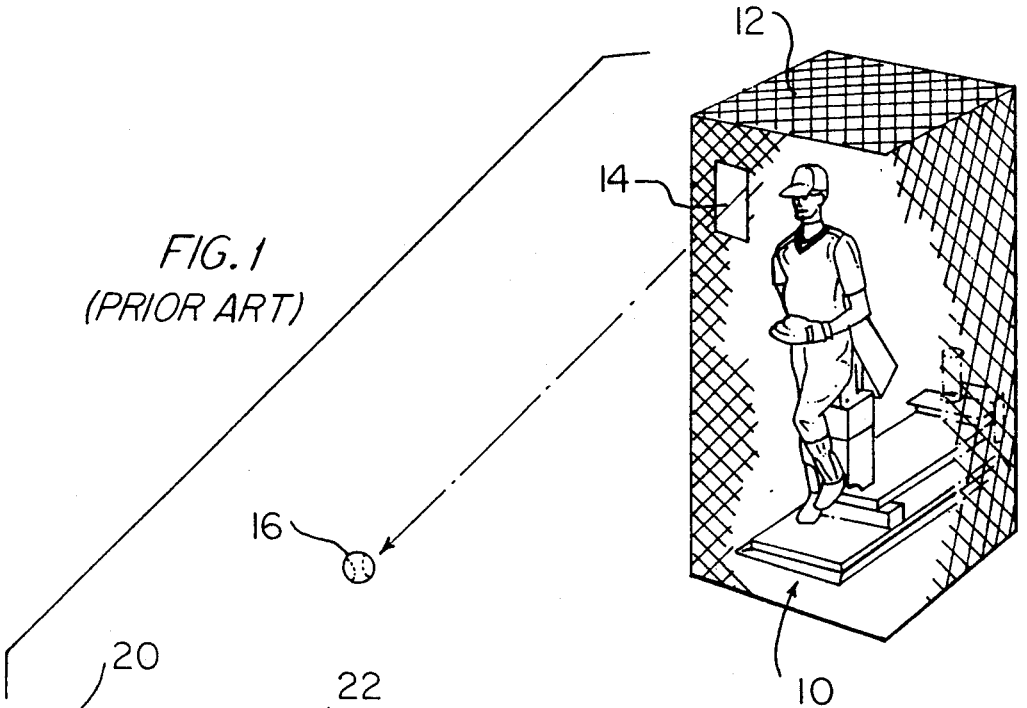
FIG. 1 (PRIOR ART)
FIG. 1 is an oblique view of a pictorial representation of a batting practice system of the prior art in which the present invention may be used.

With reference now to the figures and especially to FIG. 1, the pitching machine of the present invention may be used in a batting practice system in which a pitching machine 10 may be enclosed in a safety net 12 having a window 14 through which the pitched ball 16 is delivered. The pitched ball is directed toward a home plate 18 beyond which there may be located a backstop 20. A control box 22 may be located near home plate so the batter may operate the pitching machine and select the location and speed of the pitches.

Figure 2:
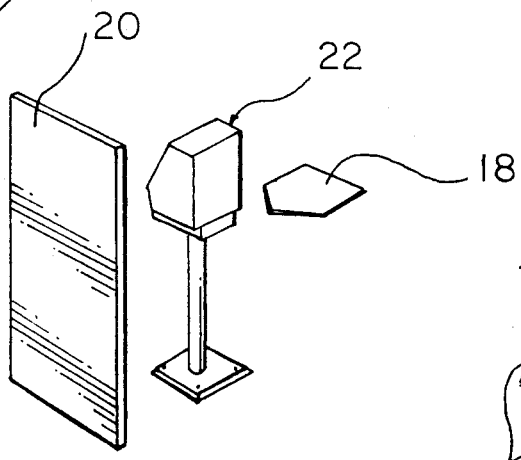
FIG. 2 is a pictorial representation of a rear oblique view of an embodiment of the present invention.
Figure 2:
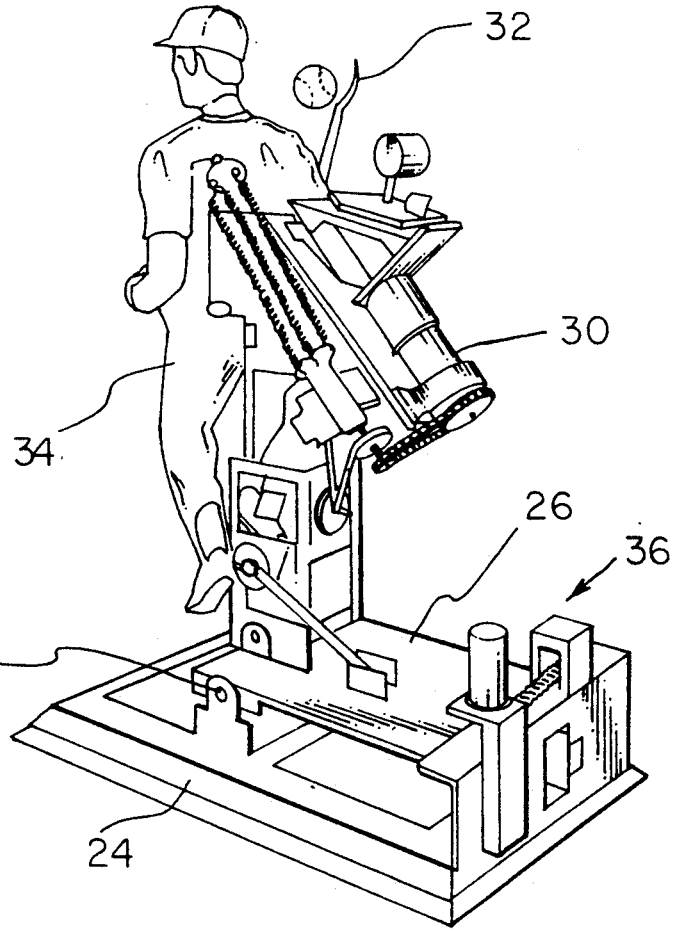

With reference now to FIG. 2, the present invention may include a primary platform 24 that provides a substantially immoveable base for the pitching machine. The primary platform 24 may be a separable element as shown in the figures or may be a part of a foundation structure, such as the concrete floor of a batting practice cage (not shown). A secondary platform 26 may be mounted on one end to the primary platform 24 with hinges 28 or other appropriate means so that it may be inclined relative to the primary platform 24.

The secondary platform 26 carries a ball throwing assembly 30 of the type generally known in the art, such as an assembly that uses a catapult-like pitching arm 32, or juxtaposed, oppositely rotating wheels (not shown). By way of example, the assembly 30 shown in FIG. 2 is disclosed in Japanese Application Disclosure No. 63-38560, that is incorporated herein by reference. The ball throwing assembly 30 is desirably hidden behind a mannequin 34 or other human-like form.

In operation, the speed of the pitched ball is determined by the force applied by the ball throwing assembly 30 and the elevation of the pitched ball is determined by the inclination of the secondary platform 26. In the present invention, the inclination of the secondary platform 26 is set by operation of the elevation assembly 36.

Figure 3:
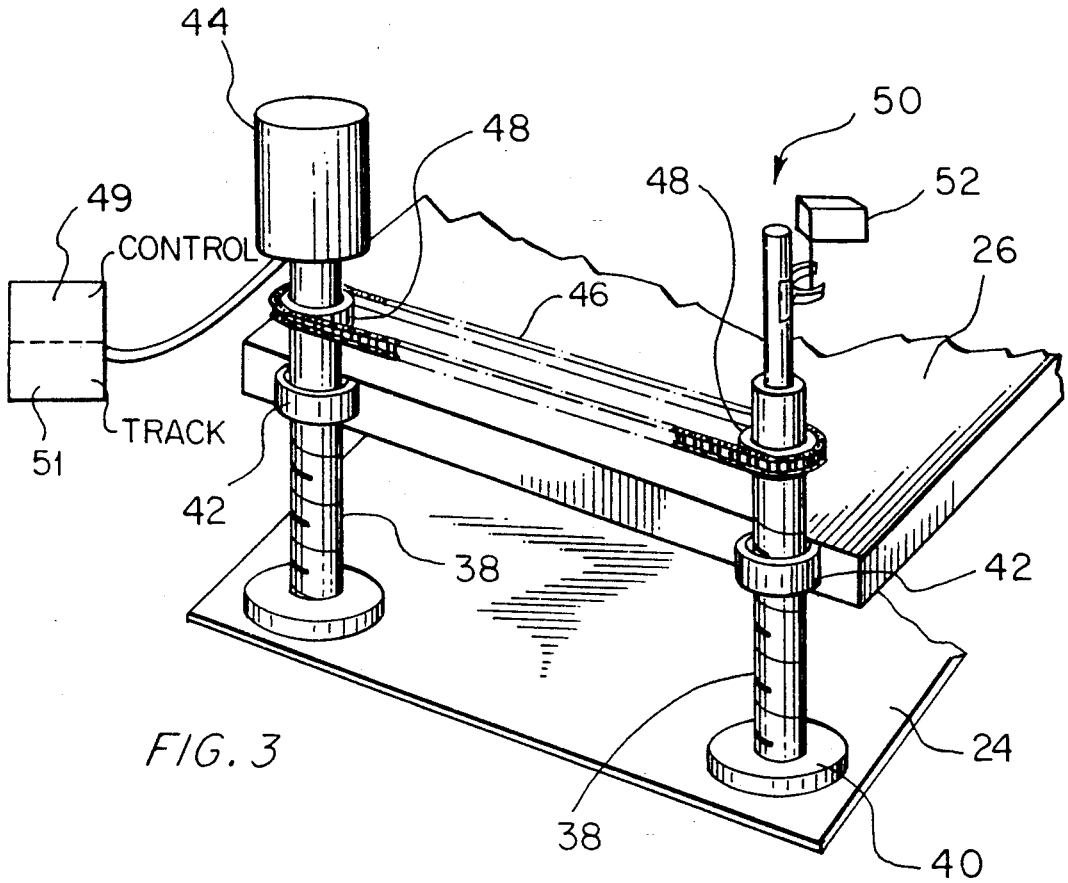
FIG. 3 is a partial pictorial representation of an oblique view of the elevation assembly of the present invention.
Figure 4:
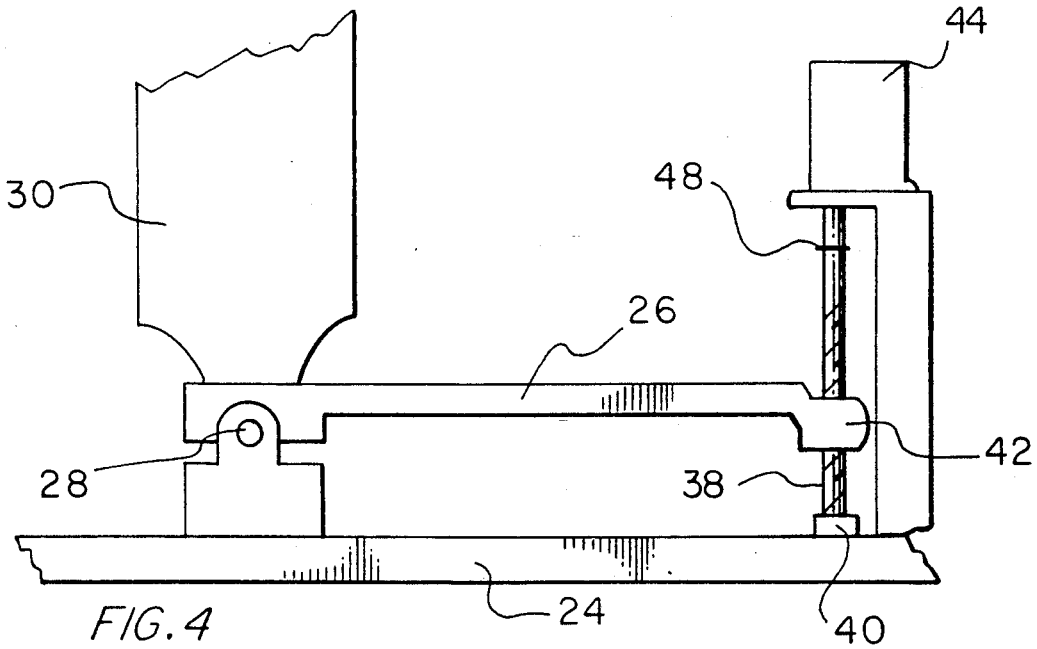
FIG. 4 is a side view of a partial pictorial representation of the elevation assembly of the present invention.
Figure 5:
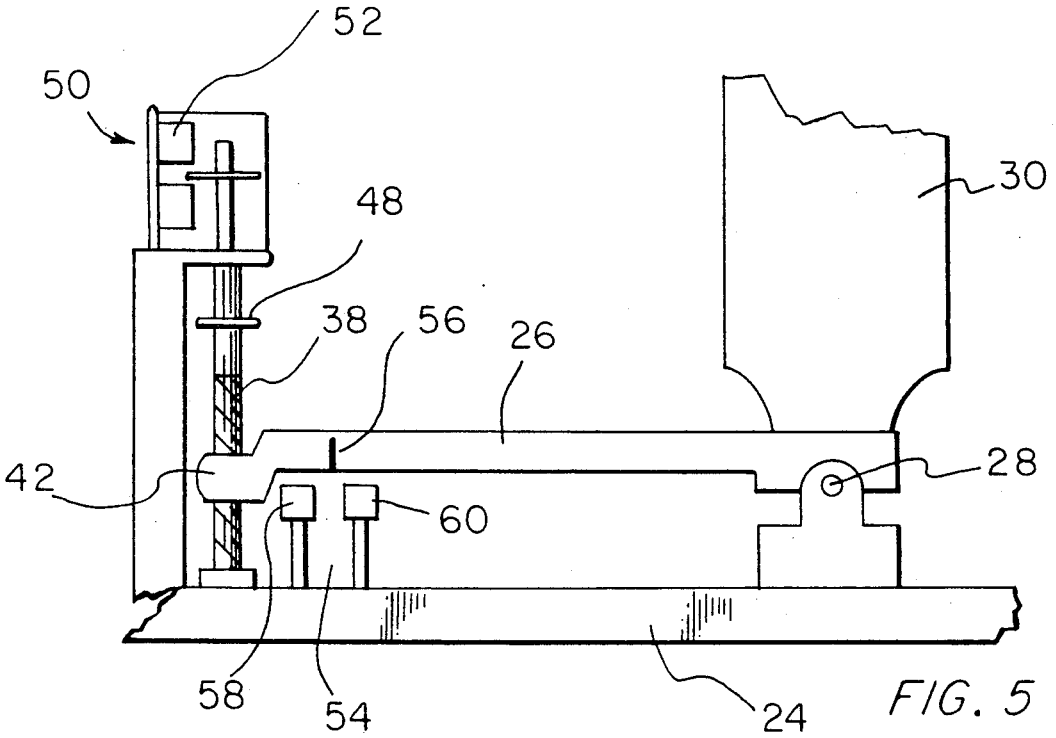
FIG. 5 is a view of the opposite side of the elevation assembly illustrated in FIG. 4.

The operation of the elevation assembly 36 may be more clearly seen with reference to FIGS. 3, 4 and 5. The secondary platform 26 may be inclined relative to the primary platform 24 by means of two or more jack screws 38 that may be held in place on the primary platform 24 by conventional bearing or support means 40. The jack screws 38 may be wound through nut assemblies 42 that are attached to the secondary platform 26 so that whem the jack screws are rotated, the inclination of the secondary platform 26 is changed. A conventional motor 44 for rotating the jack screws may be connected to one of the jack screws. The jack screws 38 may be rotated the same amount by means of a chain 46 carried by sprockets 48 attached to each of the jack screws 38. The motor 44 may be connected to a control assembly 49, such as control box 22 shown in FIG. 1, so that a batter may select the desired elevation of the pitched ball by causing the motor 44 to rotate the jack screws 38 and to thereby incline the secondary platform 26. The control assembly 49 may include conventional means 51 for tracking the inclination of the secondary platform 26, either directly or indirectly in terms of the expected elevation of the pitched ball.

The aforementioned arrangement of jack screws connected by a linking mechanism such as the chain 46 provides an increased amount of stability to the secondary platform 26 so that movement thereof is damped between pitches, improving the accuracy of the pitched ball.

The rotation of the jack screws 38 may be tracked by means of a turn counting assembly 50 that may include a counter 52 for counting the number of turns of the jack screws 38 by conventional mechanical or other means. For example, the counter 52 may keep track of the number of turns by adding and subtracting up and down turns, respectively. The counter may provide a signal to the control assembly 49 so that the inclination of the secondary platform may be tracked therein.

Figure 6:
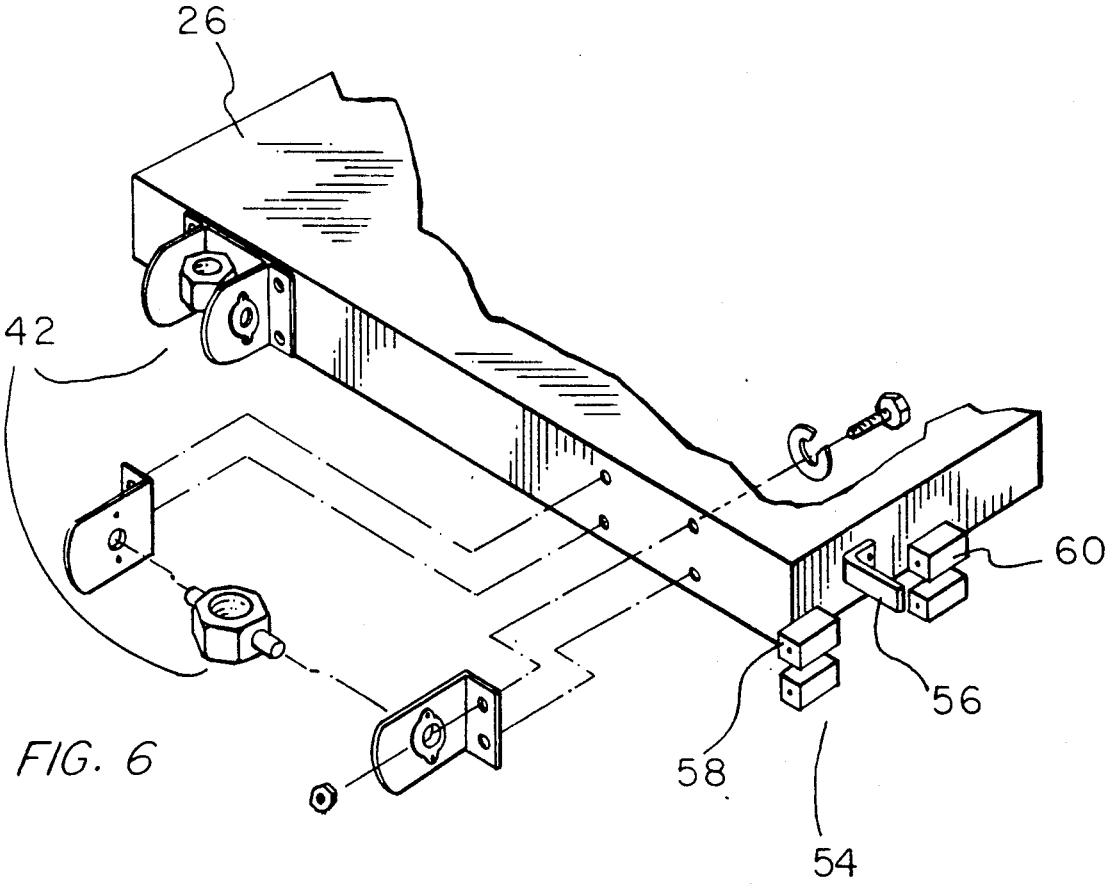
FIG. 6 is an exploded pictorial representation of the indexing assembly of the present invention.

In operation the shocks to the secondary platform 26 caused by the ball throwing assembly 30 or by malfunctions may disrupt the normal operation of the elevation assembly 36 and cause the control assembly 49 to lose track of the actual inclination of the secondary platform 26. With reference now to FIGS. 5 and 6, the inclination tracked in the control assembly 49 may be corrected by means of an indicator assembly 54. Such an assembly may include a position indicator 56 mounted on the secondary platform 26. The position indicator 56 may be mounted so that the indicator 56 comes between a pair of a light emitter 58 and a light receiver 60 when the secondary platform 26 is at a predetermined inclination. For example, the pair of emitter 58 and receiver 60 may be a photocoupler that provides a signal when the light receiver no longer is receiving light from the light emitter; that is, when the secondary platform 26 is at the predetermined inclination. The predetermined inclination may be any appropriate angle, such as zero degrees. When the inclination of the secondary platform 26 is the predetermined inclination, the light receiver 60 may send a signal to the control assembly 49. Upon receipt of the signal, the tracker 51 in the control assembly 49 may update its record of the inclination to match the predetermined inclination.

Accordingly, the indicator assembly 54 measures the actual inclination and signals the control assembly 49 so that it may be brought into agreement with the actual inclination, thereby preventing the pitched ball from being thrown widely.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

I claim:

1. A baseball pitching machine for accurately pitching a baseball at a predetermined elevation across a home plate spaced apart from the machine, the machine comprising:

a. a primary platform:

b. a secondary platform hingedly mounted at one end on said primary platform so that said secondary platform may be inclined relative to said primary platform whereby the elevation of a baseball pitched by said machine may be adjusted;

c. a ball throwing assembly mounted on said secondary platform, said assembly having means for pitching a baseball;

d. elevation means for adjusting and determining the inclination of said secondary platform relative to said primary platform so that said ball throwing assembly can pitch a baseball at said predetermined elevation; and e. indicator means for indicating when said secondary platform has a predetermined inclination so that the inclination determined by said elevation means can be corrected to match said predetermined inclination to allow the machine to operate accurately, said indicator means comprising, i. a position indicator mounted on said secondary platform, and ii. a light emitter, and a light receiver for receiving light from said light emitter, said light emitter and said light receiver being carried by said primary platform so that said position indicator prevents light from said light emitter from reaching said light receiver when said secondary platform is at said predetermined inclination.

2. The baseball pitching machine as defined in claim 1 wherein said elevation means comprises plural spaced-apart jack screws, each for raising and lowering a portion of said unhinged end of said secondary platform.

3. The baseball pitching machine as defined in claim 1 wherein said ball throwing assembly comprises a mannequin having as one of its arms a rotating arm for pitching a baseball.

4. In a baseball pitching machine having a ball throwing assembly mounted on a secondary platform that may be inclined relative to a base therefor to adjust the elevation of a pitched baseball, the improvement comprising:

a. counter means for determining the inclination of the secondary platform relative to its base that may be reset to be indicative of the actual inclination of the secondary platform in the event said counter means does not indicate the actual inclination; and b. photocoupler means for determining when said secondary platform has a predetermined inclination and for thereupon indicating to said counter means that it is to be reset to be indicative of the predetermined inclination.

5. The improvement defined in claim 4, further comprising plural jack screws for stabilizing the secondary platform.

* * * * *